US006977633B1

(12) United States Patent
Shino et al.

(10) Patent No.: US 6,977,633 B1
(45) Date of Patent: Dec. 20, 2005

(54) AC PLASMA DISPLAY PANEL

(75) Inventors: Taichi Shino, Nara (JP); Takio Okamoto, Shiga (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 116 days.

(21) Appl. No.: 09/695,869

(22) Filed: Oct. 26, 2000

(30) Foreign Application Priority Data

Oct. 27, 1999 (JP) ..... 11-305052

(51) Int. Cl.[7] ..... G09G 3/28
(52) U.S. Cl. ..... 345/67
(58) Field of Search ..... 345/55, 60, 67, 345/68; 315/169.3, 169.4, 169.1; 313/584, 313/586, 587, 585

(56) References Cited

U.S. PATENT DOCUMENTS 5,939,828 A * 8/1999 Matsuzaki et al. ..... 313/584
6,275,203 B1 * 8/2001 Yamada ..... 345/60
6,288,692 B1 * 9/2001 Kanazawa et al. ..... 345/67
6,320,326 B1 * 11/2001 Shino et al. ..... 315/169.4
6,344,841 B1 * 2/2002 Moon ..... 345/60
6,411,035 B1 * 6/2002 Marcotte ..... 313/585

* cited by examiner

*Primary Examiner*—Chanh Nguyen
(74) *Attorney, Agent, or Firm*—Wenderoth, Lind & Ponack, L.L.P.

(57) ABSTRACT

An alternating current (AC) plasma display panel is provided that emits little electromagnetic waves and which has no brightness irregularity. In this panel, pairs of scan electrodes and sustain electrodes are provided in rows, and data electrodes arranged orthogonally to the pairs of scan electrodes and sustain electrodes constitute a matrix. A conductor is disposed in each row in parallel with the scan electrodes and the sustain electrodes. The scan electrodes are coupled with a scan electrode driving circuit on the left side of the panel. The conductors are electrically coupled with the sustain electrodes on the right side of the panel and are connected with a sustain electrode driving circuit on the left side of the panel. When a sustain pulse voltage is applied, a current runs through the conductors in a direction reverse to a direction of the sustaining discharge current running through the scan electrodes and the sustain electrodes.

4 Claims, 10 Drawing Sheets

AC PLASMA DISPLAY PANEL

FIELD OF THE INVENTION

The present invention relates to an alternating current (AC) plasma display panel (hereinafter called a panel) used for an image display of a television receiver or an information display terminal.

BACKGROUND OF THE INVENTION

FIG. 10 shows a conventional panel and its driving apparatus. On panel 1, a sustaining discharge generated between pairs of scan electrodes and sustain electrodes causes a phosphor to emit light for display. 2M rows of pairs of scan electrodes $SCN_j$ and sustain electrodes $SUS_j$(j=1 to 2M) and N rows of data electrodes $D_i$ (i=1 to N), which are arranged orthogonally to the scan electrodes and sustain electrodes, constitute a matrix with 2M rows and N columns. Discharge cells are formed at intersections between the data electrode $D_i$ and the pairs of scan electrodes $SCN_j$ and sustain electrodes $SUS_j$. Over panel 1, pairs of scan electrodes $SCN_j$ and sustain electrodes $SUS_j$ extend out reversely to each other. The scan electrodes in any adjacent rows extend out reversely to each other over the panel. The sustain electrodes in any adjacent rows extend out reversely to each other over the panel.

In other words, scan electrodes $SCN_1$, $SCN_3$, . . . $SCN_{2m-1}$ in odd-numbered rows extend out to the left side of panel 1 and are connected to a scan electrode driving circuit 2*a* which drives these scan electrodes. Sustain electrodes $SUS_1$, $SUS_3$, . . . $SUS_{2M-1}$ in odd-numbered rows extend out to the right side of panel 1 and are connected to a sustain electrode driving circuit 3*a* which drives these sustain electrodes. Scan electrodes $SCN_2$, $SCN_4$, . . . $SCN_{2M}$ in even-numbered rows extend out to the right side of panel 1 and are connected to scan electrode driving circuit 2*b* which drives these scan electrodes. Sustain electrodes $SUS_2$, $SUS_4$, . . . $SUS_{2M}$ in even-numbered rows extend out to the left side of panel 1 and are connected to sustain electrode driving circuit 3*b* which drives these sustain electrodes. Data electrodes $D_1$, . . . $D_N$ extend out to the upside of panel 1 and are connected to a data electrode driving circuit 4 for driving the data electrodes.

When a sustain pulse voltage for causing the sustaining discharge is applied on the sustain electrodes or scan electrodes on panel 1, pulse currents having extremely short time-width that do not contribute to light emission run through respective rows, and therefore electromagnetic waves occur in the respective rows. Because the currents in any of the adjacent rows run reversely to each other, the electromagnetic waves have reverse polarities and therefore cancel each other.

However, when an operation of scan electrode driving circuit 2*a* is out of accord with that of scan electrode driving circuit 2*b*, an operation of sustain electrode driving circuit 3*a* is thereby out of accord with sustain electrode driving circuit 3*b*. And if the applying time of the sustain pulse voltages in any of the adjacent rows is even slightly out of accord with each other, then the time of generating pulse currents is out of accord with each other, and therefore the electromagnetic waves do not cancel each other. As a result, the electromagnetic waves are radiated out of the panel, which therefore causes the other electronic apparatus to malfunction.

For preventing the electromagnetic wave from being radiated out of the panel, it is considered that all scan electrodes $SCN_1$–$SCN_{2m}$ and sustain electrodes $SUS_1$–$SUS_{2M}$ extend out in the same direction, such as on the left side of the panel, for example, and are connected to the scan electrode driving circuit and the sustain electrode driving circuit, respectively. In this case, currents which are the same in amplitude run reversely through the scan electrode and the sustain electrode in each row, and thus the electromagnetic waves generated by reversely running currents therefore cancel each other. As a result, the electromagnetic waves are not radiated out of the panel.

In this case, however, the sum of the path length through which the current runs from the scan electrode driving circuit to a discharge cell and the path length through which the current runs from the discharge cell to the sustain electrode driving circuit varies depending on a position of the discharge cell in the panel. In other words, the current running path length to the discharge cell on the right side of the panel is smaller than that on the left side of the panel. Therefore, due to a voltage drop caused by the resistance of the electrodes, a voltage that is applied between the scan electrode and the sustain electrode for each discharge cell varies depending on the position of the discharge cells. Since strength of the discharge varies for each cell, brightness irregularity occurs.

SUMMARY OF THE INVENTION

An alternating current (AC) plasma display panel is provided that hardly generates an electromagnetic wave and has good display quality without brightness irregularity.

The plasma display panel comprises two substrates arranged with a discharge space therebetween, and scan electrodes, sustain electrodes and conductors adjoin one another in a row over one substrate. When a sustain pulse voltage is applied between the scan electrodes and the sustain electrodes, an electromagnetic wave with a polarity reverse to the polarity of an electromagnetic wave generated by currents running through the scan electrodes and the sustain electrodes is generated on the conductors. The electromagnetic wave emitted from the currents running through the scan electrodes and the sustain electrodes cancels the electromagnetic wave generated from the current running through the conductors.

DESCRIPTION OF THE PREFERRED EMBODIMENTS

First Embodiment

Figure 1:
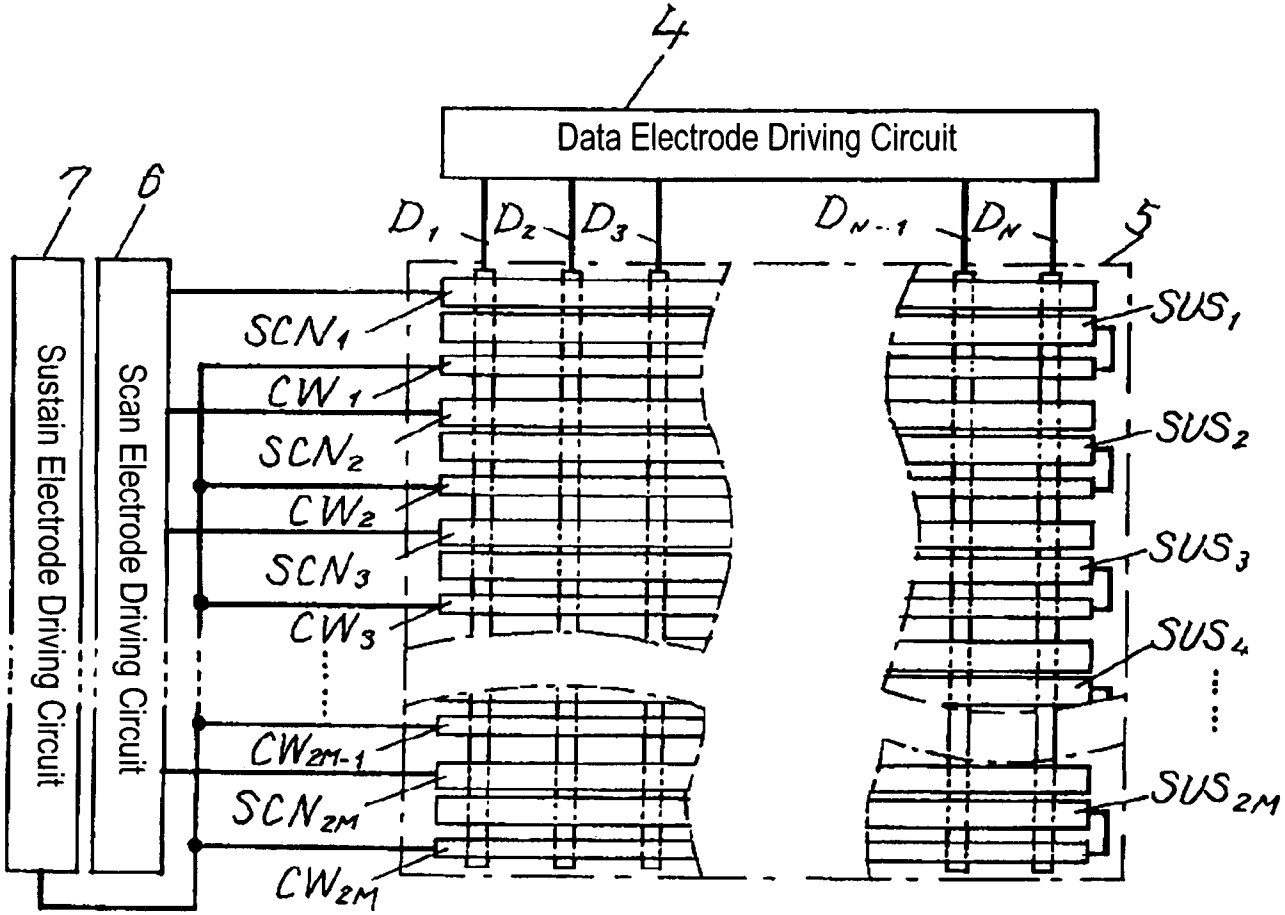
FIG. 1 is a schematic block diagram of an alternating current (AC) plasma panel and a driving apparatus in accordance with a first embodiment of the present invention.

FIG. 1 shows an alternating current (AC) plasma display panel and its driving apparatus in accordance with the first embodiment of the present invention. In FIG. 1, 2M rows of pairs of scan electrodes $SCN_j$ and sustain electrodes $SUS_j$ (j=1 to 2M) form display electrodes over panel 5. N columns of data electrodes $D_i$ (i=1 to N) are arranged orthogonally to the scan electrodes and sustain electrodes. In other words, scan electrode $SCN_j$ and sustain electrode $SCN_j$ adjoining each other constitute a row in a stripe pattern, and data electrodes $D_i$ constitute columns. A discharge cell is formed at an intersection of each row and each column, and 2M×N discharge cells are formed in a matrix shape. In addition, in each row, conductor $CW_j$, which is parallel with scan electrode $SCN_j$ and sustain electrode $SUS_j$, is arranged adjacent to sustain electrode $SUS_j$ without being put adjacent to both scan electrode $SCN_j$ and sustain electrode $SUS_j$, and these three electrodes constitute one set. Conductor $CW_j$ is electrically connected to sustain electrode $SUS_j$. In FIG. 1, scan electrode $SCN_j$, sustain electrode $SUS_j$, and conductor $CW_j$ are arrayed in this order in each row. However, they may be arrayed in the order of conductor $CW_j$, sustain electrode $SUS_j$, and scan electrode $SCN_j$, or in the order of conductor $CW_j$, scan electrode $SCN_j$, and sustain electrode $SUS_j$.

Scan electrodes $SCN_1$–$SCN_{2M}$ are connected to a scan electrode driving circuit 6 on the left side of the panel. Conductors $CW_1$–$CW_{2M}$ are respectively connected electrically to sustain electrodes $SUS_1$–$SUS_{2M}$ on the right side of the panel and connected to sustain electrode driving circuit 7 on the left side of the panel. Data electrodes $D_1$–$D_N$ are connected to a data electrode driving circuit 4 on the upside of the panel.

Figure 2:
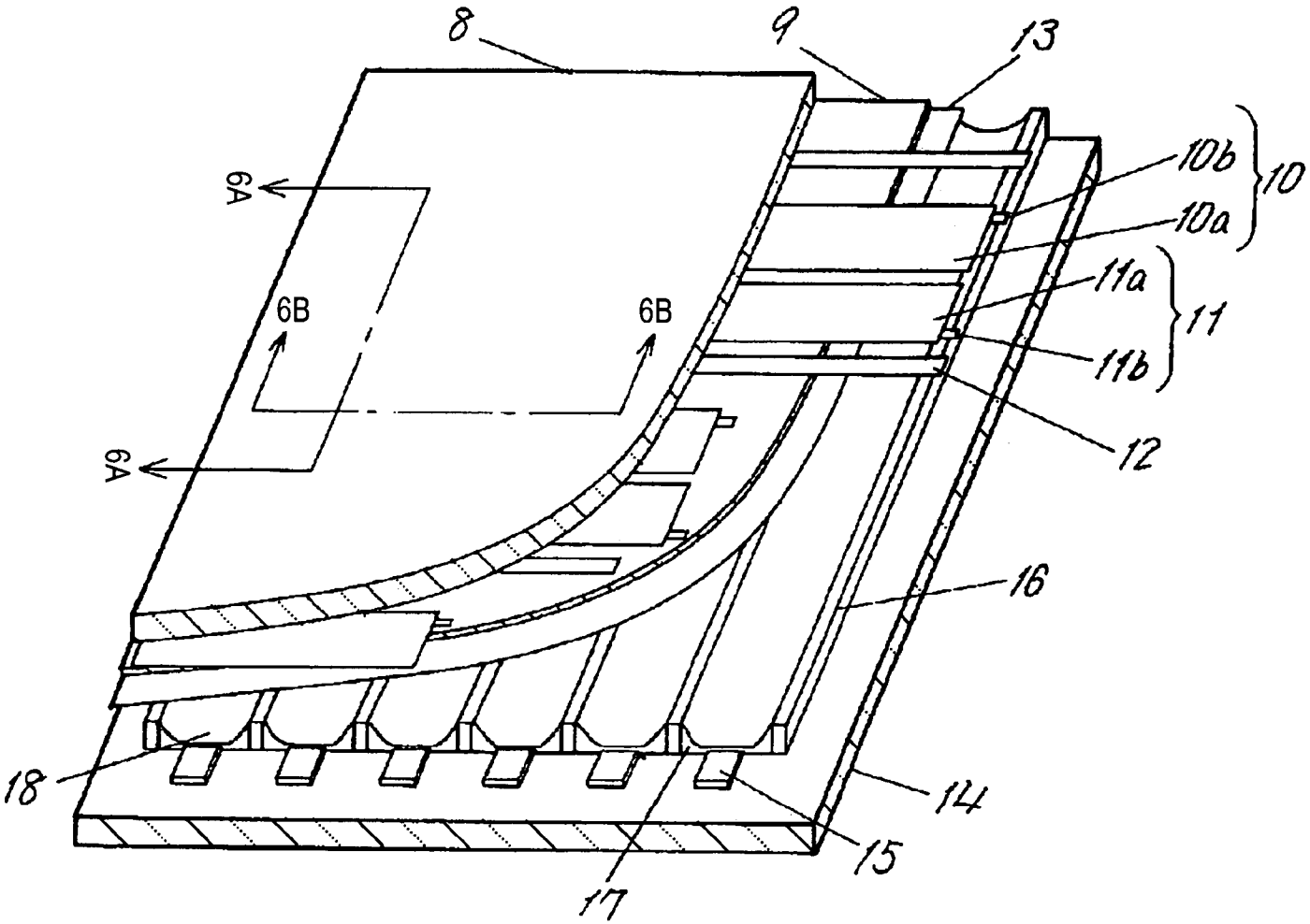
FIG. 2 is a partial perspective view of the panel in accordance with a first example of the first embodiment of the present invention.

FIG. 2 is a partial perspective view of panel 5 of the first example of the first embodiment of the present invention. A plurality of scan electrodes 10 ($SCN_j$), sustain electrodes 11 ($SUS_j$), and conductors 12 ($CW_j$) which are covered by dielectric layer 9 are disposed over insulating substrate 8 in the row direction, and protective coat 13 is placed on dielectric layer 9. Each scan electrode 10 is constituted with transparent electrode 10*a* and bus 10*b* overlapping on electrode 10*a*, and, each sustain electrode 11 is constituted with transparent electrode 11*a* and bus 11*b* overlapping on electrode 11*a*. A resistance of the transparent electrodes is generally high, and the buses, which are made of silver or the like, are overlapped on the transparent electrodes. Resistance of the scan electrodes is thus lowered. Conductor 12 is formed by a lower-resistance material made of silver or the like.

A plurality of data electrodes 15 ($D_i$) are disposed over insulating substrate 14 in the column direction, and a barrier rib 16 in parallel with data electrode 15 is arranged between the data electrode 15. Phosphor 17 is placed on the surface of data electrode 15 and the side surface of barrier rib 16. Insulating substrate 8 and insulating substrate 14 are arranged such that they face each other. The discharge space 18, which is surrounded by insulating substrate 8, insulating substrate 14, and barrier rib 16, is filled with discharge gas containing xenon and at least one of helium, neon, or argon.

The panel performs a sustaining discharge between each pair of scan electrode 10 and sustain electrode 11. A distance between conductor 12 and scan electrode 10 in its adjoining row is provided to be long enough in order to prevent a false discharge between conductor 12 in any row and scan electrode 10 in its adjoining row.

Figure 3:
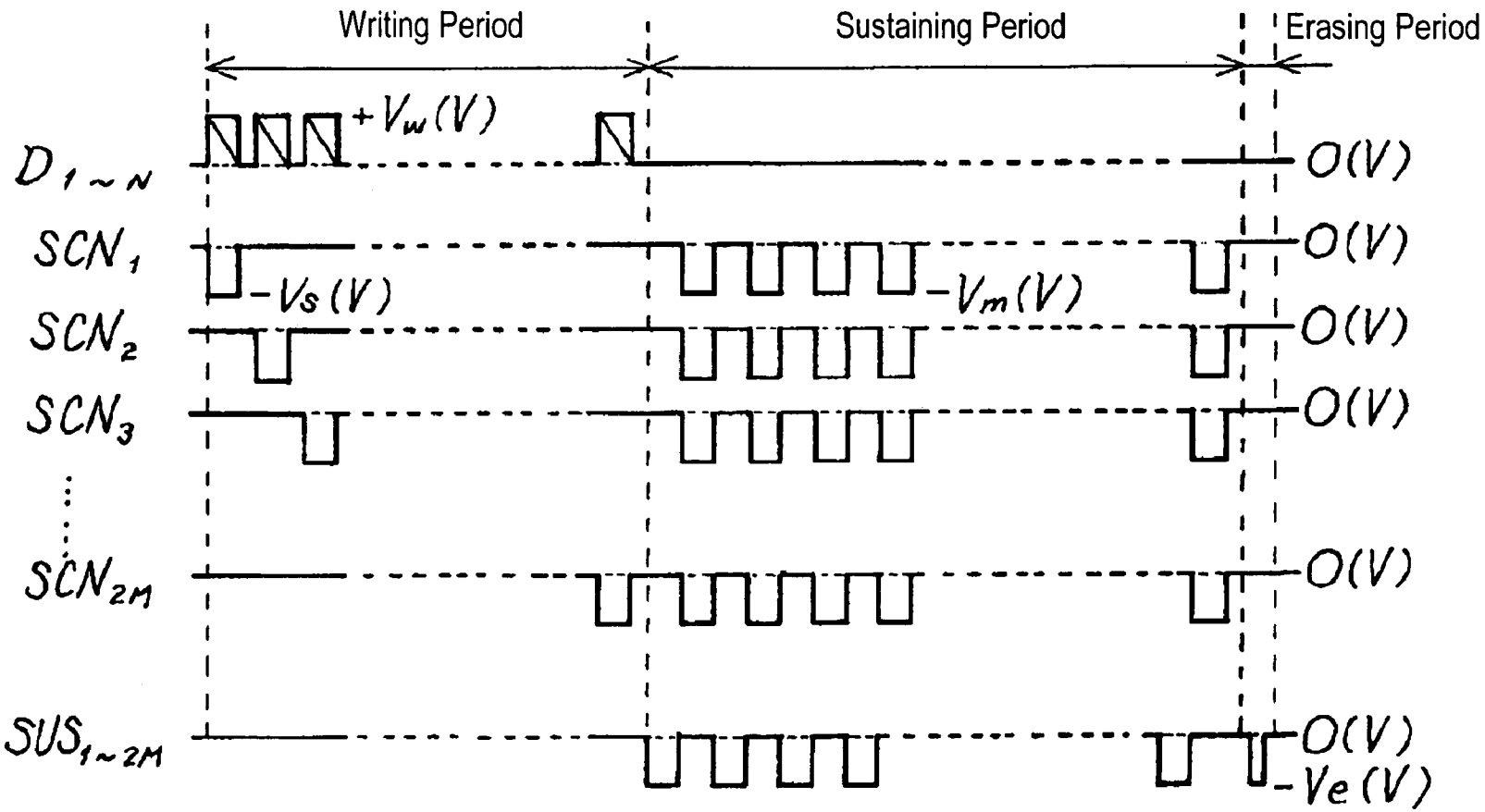
FIG. 3 shows a driving time of the panel in accordance with the first example of the first embodiment of the present invention.

A method for driving the panel in accordance with the first embodiment of the present invention is hereinafter described. FIG. 3 shows a driving time-chart of an operation of the panel. The operation is described with reference to FIG. 1 through FIG. 3.

First, during a writing period, sustain electrode driving circuit 7 maintains all sustain electrodes $SUS_1$–$SUS_{2M}$ to 0 (V) through conductors $CW_1$–$CW_{2m}$. During scanning of the first row, positive writing pulse voltage +Vw (V) is applied from the data electrode driving circuit 4 to a data electrode $D_i$ corresponding to a discharge cell for performing a display in data electrodes $D_1$–$D_N$. Negative scan pulse voltage −Vs (V) is applied from the scan electrode driving circuit 6 to scan electrode $SCN_1$, in the first row, and then writing discharge occurs at the discharge cell at the intersection of data electrode $D_i$ and scan electrode $SCN_1$. By scanning from the second row to the 2M-th row similar to the scanning described with respect to the first row, writing discharge occurs at discharge cells for performing a display.

During a sustaining period subsequent to the writing period, sustain electrode driving circuit 7 applies negative sustain pulse voltage −Vm (V) to all sustain electrodes $SUS_1$–$SUS_{2M}$ through conductors $CW_1$–$CW_{2M}$. In the discharge cells where the writing discharge occurs, the initial sustaining discharge occurs between scan electrode $SCN_j$ and sustain electrode $SUS_j$, and a sustaining discharge current runs from the scan electrode driving circuit 6 to the sustain electrode driving circuit 7 through scan electrode $SCN_j$, sustain electrode $SUS_j$, and conductor $CW_j$. Then, sequentially, the scan electrode driving circuit 6 and the sustain electrode driving circuit 7 alternately apply negative sustain pulse voltage −Vm (V to all sustain electrodes $SUS_1$–$SUS_{2M}$ and scan electrodes $SCN_1$–$SCN_{2M}$ through conductors $CW_1$–$CW_{2M}$, respectively. Thus, the sustaining discharge continues between scan electrode $SCN_j$ and sustain electrodes $SUS_j$ in the discharge cells where the writing discharge occurs. In addition, the sustaining discharge current from the sustain electrode driving circuit 7 to the scan electrode driving circuit 6 through conductor $CW_j$, sustain electrode $SUS_j$, and scan electrode $SCN_j$, and the sustaining discharge current from the scan electrode driving circuit 6 to the sustain electrode driving circuit 7 through scan electrode $SCN_j$, sustain electrodes $SUS_j$, and conductor $CW_j$ alternately run. Light emitted by this continuing sustaining discharge is used for display.

Subsequently, during an erasing period, the sustain electrode driving circuit 7 applies negative narrow-width cancellation pulse erasing voltage −Ve (V) to all sustain electrodes $SUS_1$–$SUS_{2M}$ through conductors $CW_1$–$CW_{2M}$ to generate an erasing discharge and to stop the sustaining discharge. By the operation discussed above, the whole screen of the panel is displayed.

Effects of the panel and its driving apparatus are hereinafter described.

Figure 4:
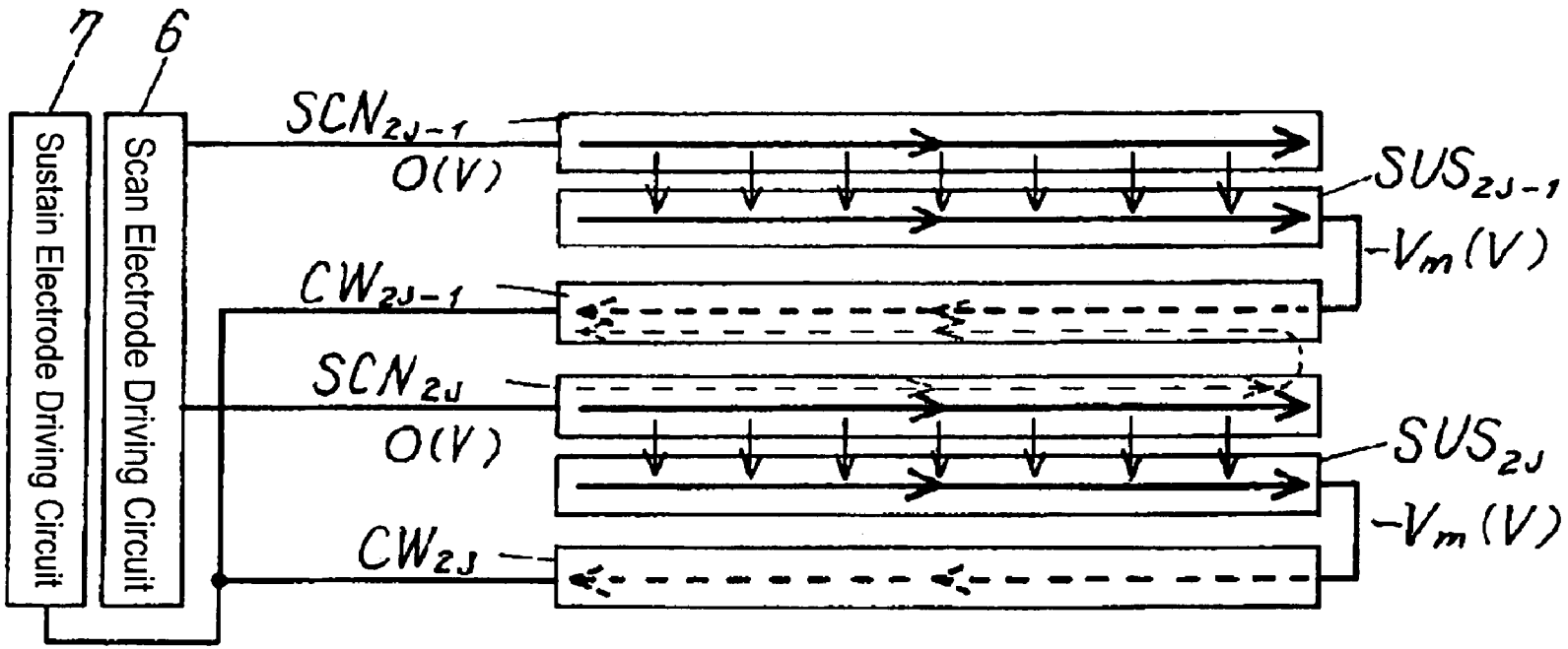
FIG. 4 shows a partial electrode array of the panel and the driving apparatus in accordance with the first example of the first embodiment of the present invention.
Figure 5A:
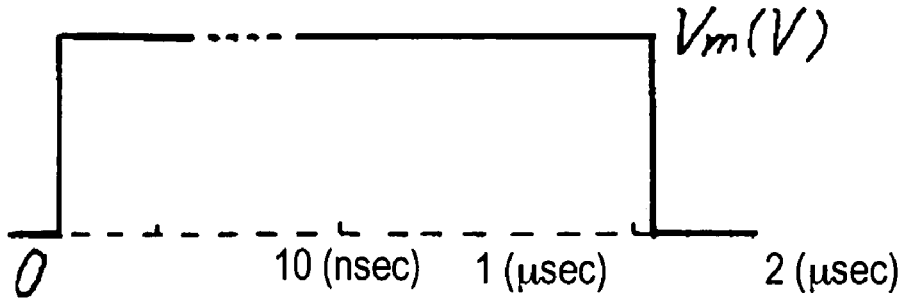
FIGS. 5A, 5B, and 5C show a pulse voltage applied to electrodes over the panel and sustaining discharge currents in accordance with the first example of the first embodiment of the present invention.
Figure 5B:
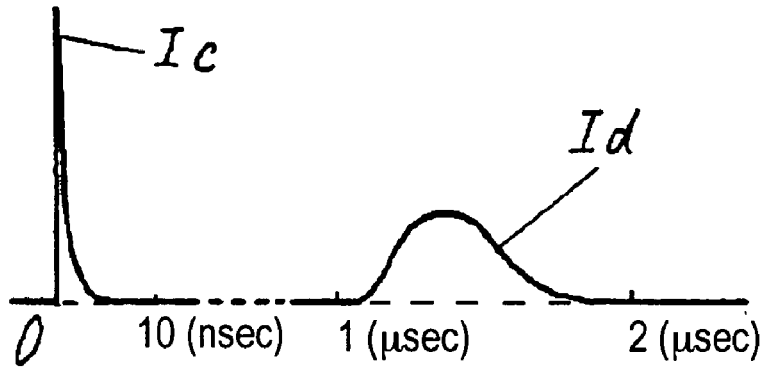
Figure 5C:
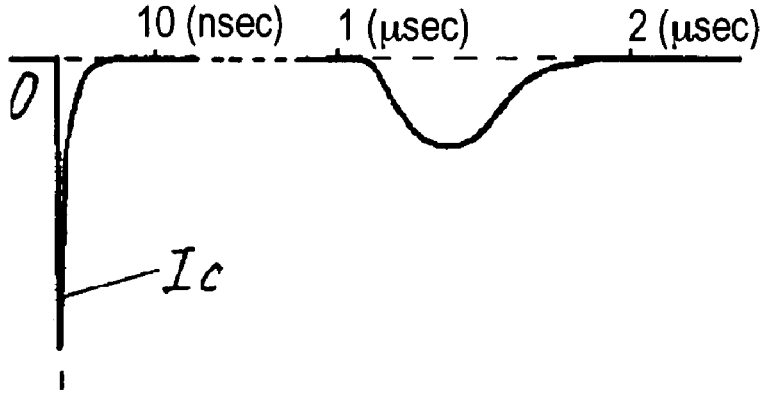

FIG. 4 shows an electrode array in the (2j−1)-th and 2j-th rows, namely, a part of the panel shown in FIG. 1. In FIG. 4, a current running when the sustain pulse voltage is first applied during the sustaining period is represented by arrows. FIG. 5A, FIG. 5B, and FIG. 5C show a wave form of the sustain pulse voltage and currents at this time. FIG. 5A shows the voltage wave form at scan electrode $SCN_{2j-1}$ with reference to sustain electrode $SUS_{2j-1}$ when the sustain electrode driving circuit 7 applies negative sustain pulse voltage −Vm (V) to sustain electrode $SUS_{2j-1}$. FIG. 5B shows a wave form of the current running from the scan electrode driving circuit 6 through scan electrode $SCN_{2j-1}$ and sustain electrode $SUS_{2j-1}$. FIG. 5C shows a wave form of the current running through conductor $CW_{2j-1}$. Here, a current direction from the left side to the right side of the panel is positive.

As shown in FIG. 5B and FIG. 5C, the sustaining discharge current running when the sustain pulse voltage is applied comprises current Id and current Ic. Current Id is a discharge current contributing to actual light emission, and it slowly runs with a little delay from the application of the sustain pulse voltage. Current Ic runs through a capacitor formed by the scan electrode and the sustain electrode, and is thus namely a capacitive current. Further, current Ic has a sharp peak wave form with a very narrow time-width, it is useless for the light emission, and it generates an electromagnetic wave. For convenience of explanation, the time scale on the left half is set different from that on the right half in FIG. 5.

As shown in FIG. 4, the sustaining discharge current (shown by thick solid line arrows) running from the scan electrode driving circuit 6 through scan electrode $SCN_{2j-1}$ and sustain electrodes $SUS_{2j-1}$ reaches the sustain electrode driving circuit 7 through conductor $CW_{2j-1}$ as shown by thick dashed line arrows. In other words, as shown in FIG. 5B and FIG. 5C, respectively, the current running through scan electrode $SCN_{2j-1}$ and sustain electrode $SUS_{2j-1}$ and the current running through conductor $CW_{2j-1}$ have the same amplitude and run in a reverse directions with respect to each other. In addition, these current wave forms synchronize with each other. Therefore, electromagnetic waves generated from these currents have reverse polarities and thus cancel each other.

A situation similar to the above discussion occurs for continuously generated sustaining discharge. The electromagnetic wave released by the current running through a pair of scan electrode $SCN_{2j-1}$ and sustain electrode $SUS_{2j-1}$ and the electromagnetic wave released by the current running through conductor $CW_{2j-1}$ respectively have reverse polarities and therefore cancel each other. Therefore, the electromagnetic wave radiated out of the panel is suppressed, and the other electronic apparatus is prevented from malfunctioning.

Scan electrode $SCN_{2j}$, dielectric layer 9, and conductor $CW_{2J-1}$ form a capacitor because dielectric layer 9 is formed between scan electrode $SCN_{2j}$ and conductor $CW_{2j-1}$. When sustain pulse voltage −Vm (V) is applied to conductor $CW_{2j-1}$ a capacitive current runs through this capacitor. Because the capacitive current (shown by thin dashed line arrows in FIG. 4) running through the capacitor runs from the scan electrode driving circuit 6 through scan electrode $SCN_{2j}$ and conductor $CW_{2j-1}$ to the sustain electrode driving circuit 7, the capacitive currents, which are the same in amplitude, run simultaneously in a reverse direction with respect to each other. The electromagnetic wave released by the capacitive current running through scan electrode $SCN_{2j}$ and the electromagnetic wave released by the capacitive current running through conductor $CW_{2j-1}$ respectively have reverse polarities and therefore cancel each other.

The electromagnetic waves generated by the sustaining discharge currents running through the (2j−1)-th row and the 2j-th row are canceled, respectively. The electromagnetic wave generated by the capacitive current running between the (2j−1)-th row and the 2j-th row are canceled. The electromagnetic waves generated by the currents respectively running between the (2j−1)-th row and the (2j−2)-th row and between the 2j-th row and the (2j+1)-th row are canceled. Therefore, the electromagnetic waves generated by the currents running through the (2j−1)-th row and the 2j-th row are perfectly canceled.

The effects for the electrodes in the (2j−1)-th row and the 2j-th row are discussed above, but it is clear that the electrodes in the other rows also have similar effects. During the sustaining discharge, the current running through scan electrode $SCN_j$ and sustain electrode $SUS_j$ and the current running through conductor $CW_j$ simultaneously run in reverse directions with respect to each other. The electromagnetic wave generated by the current running through scan electrode $SCN_j$ and sustain electrode $SUS_j$ and the electromagnetic wave generated by the current running through conductor $CW_j$ respectively have reverse polarities and thus perfectly cancel each other. The currents run in reverse directions respectively through conductor $CW_j$ in any row and through scan electrode $SCN_{j+1}$ in its adjacent and next row, and therefore, the electromagnetic wave generated by the currents is canceled by itself. As a result, radiation of the electromagnetic wave out of the panel is restrained.

In the panel in accordance with this embodiment, the sum of the path length through which the current runs from the scan electrode driving circuit 6 to a discharge cell and the path length through which the current runs from the discharge cell to the sustain electrode driving circuit 7 is constant independent of a position of the discharge cell in the panel. Therefore, voltage applied between the scan electrode and the sustain electrode is substantially the same for each discharge cell. As a result, the sustaining discharge with substantially the same strength occurs in each discharge cell, and brightness irregularity is hardly observed.

Figure 6A:
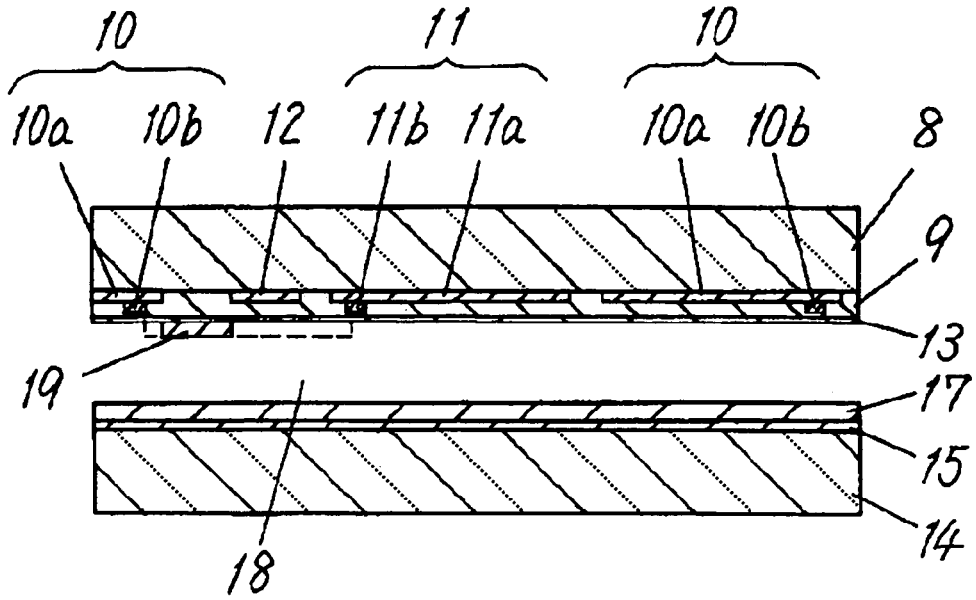
FIGS. 6A and 6B show a sectional view of a part of the panel in accordance with a second example of the first embodiment of the present invention.
Figure 6B:
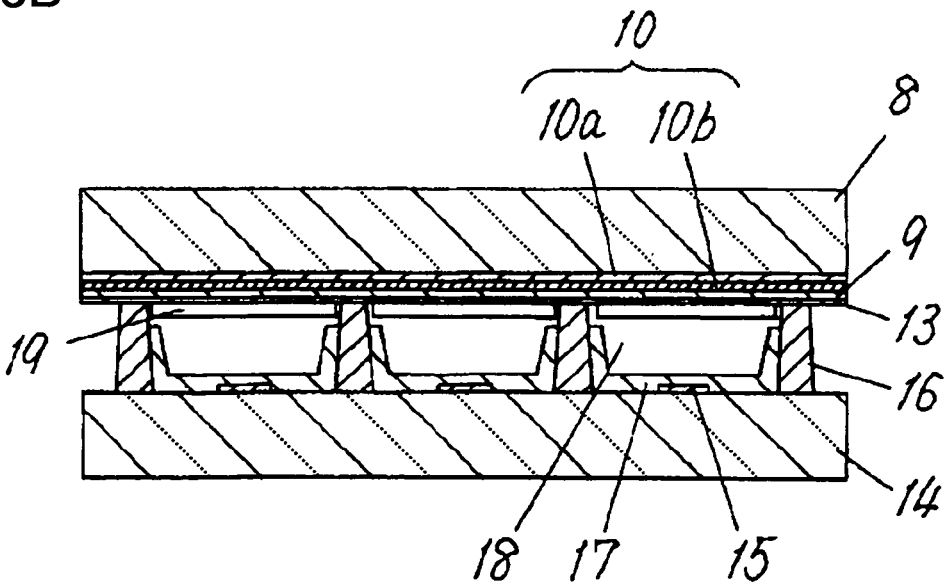

FIG. 6 shows a panel in accordance with a second example of the first embodiment of the present invention. FIG. 6A and FIG. 6B are respectively a sectional view at position 6A—6A and a sectional view at position 6B—6B of the panel in FIG. 2. In this panel, barrier 19 is disposed on dielectric layer 9 in a region between rows. In other words, in the panel of the first example of the this embodiment, barrier 19 is disposed on dielectric layer 9 between adjacent conductor 12 and scan electrode 10 in adjacent rows. Barrier 19 is shown by a solid line in FIG. 6. Barrier 19 may be also disposed across rows from the end of sustain electrode 11 in any row to the end of scan electrode 10 in its next row, as is shown by the dashed line in FIG. 6A. Due to barrier 19, an electric field in discharge space 18 between conductor 12 and scan electrode 10 in adjacent rows is remarkably weakened when a voltage is applied between conductor 12 and scan electrode 10. As a result, false discharge is further certainly prevented between rows, namely, between conductor 12 and scan electrode 10.

Figure 7A:
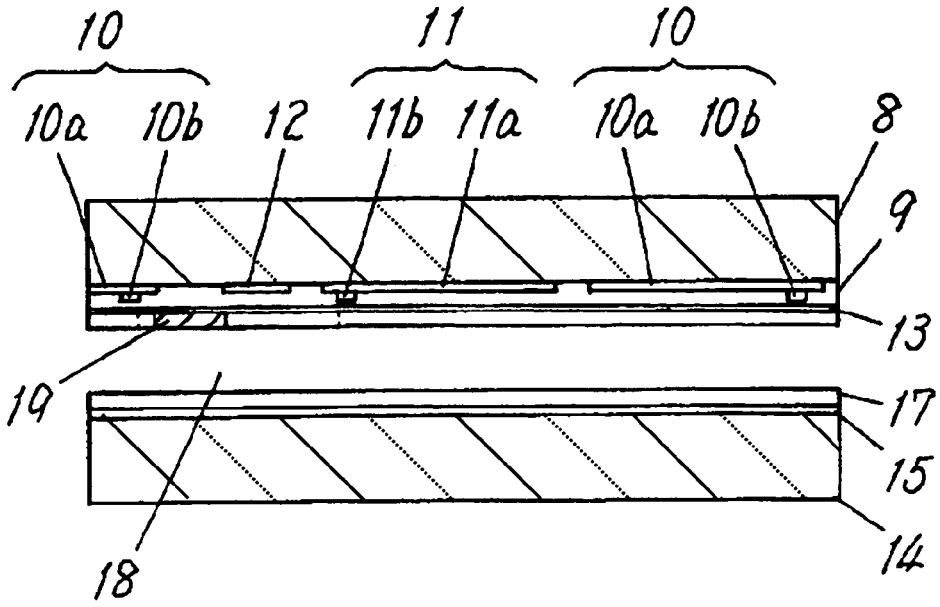
FIGS. 7A and 7B show a partial, sectional view of another constitution of the panel in accordance with the second example of the first embodiment of the present invention.
Figure 7B:
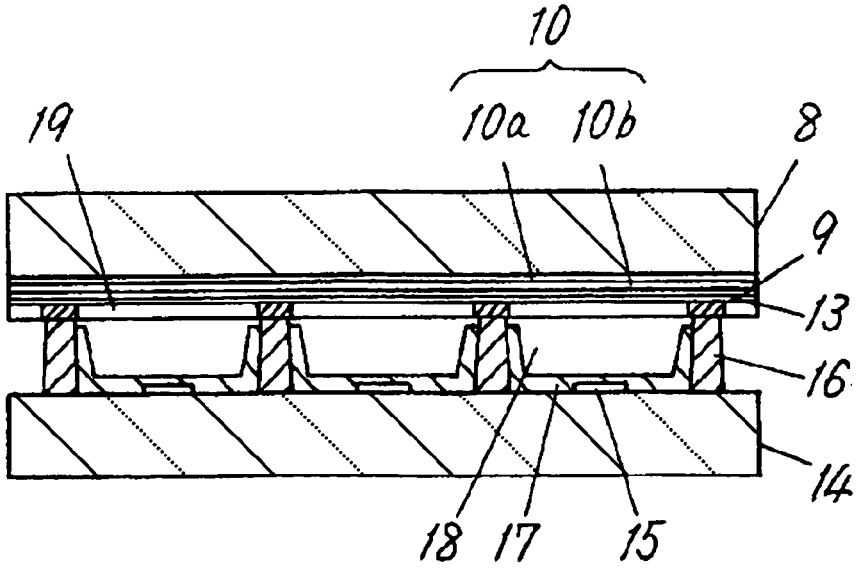

As shown in FIG. 7A and FIG. 7B, barrier 19 may have a double-cross shape where it has not only the part in the row direction discussed above but also a substantially piled on barrier rib 16 in the column direction. In this panel, an electric field in discharge space 18 between conductor 12 and scan electrode 10 in the adjoining row is remarkably weakened. As a result, any false discharge is further certainly prevented between conductor 12 and scan electrode 10 in the adjoining row.

In addition, barrier 19 is made of photo-absorptive material, and reflected external light is therefore suppressed to increase contrast of the panel. A mixture of ruthenium oxide, manganese dioxide, chromium oxide, or nickel oxide to a glass material similar to that in dielectric layer 9 or the like can be used as this photo-absorptive material.

In the first embodiment of the present invention, an example where a scan electrode driving circuit is connected to scan electrodes, and a sustain electrode driving circuit is connected to conductors coupled to sustain electrodes is described. Also, by electrically connecting the conductors to the scan electrodes, connecting the scan electrode driving circuit to the conductors, and connecting the sustain electrode driving circuit to the sustain electrodes, a current running through the scan electrodes and the sustain electrodes and a current running through the conductors may run in a reverse direction with respect to each other.

Second Embodiment

Figure 8:
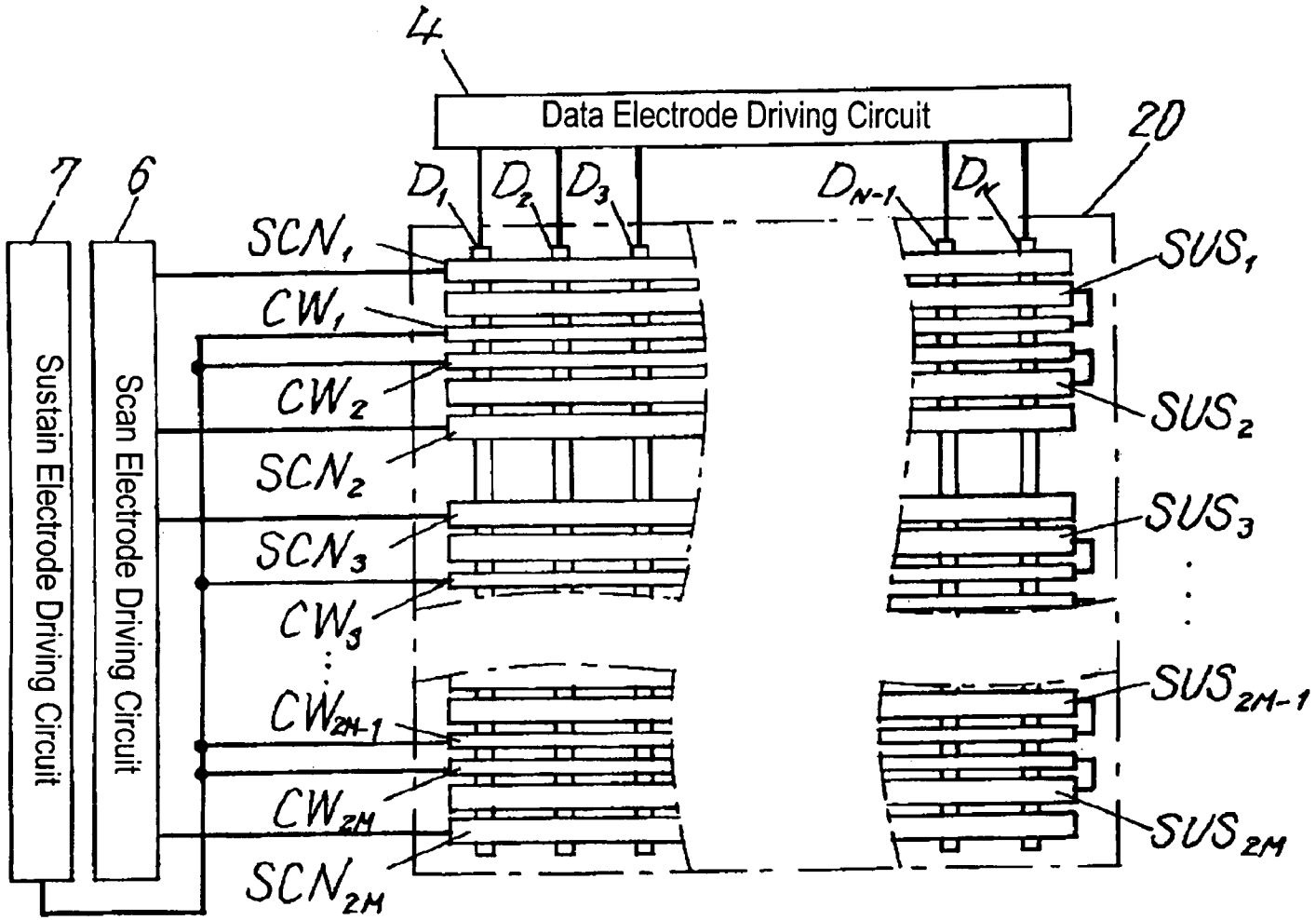
FIG. 8 is a schematic block diagram of a panel and a driving apparatus in accordance with a second embodiment of the present invention.

FIG. 8 shows a panel and its driving apparatus in accordance with the second embodiment of the present invention. In FIG. 8, panel 20 differs from panel 5 of the first embodiment in the arrangement and the connecting of scan electrode $SCN_j$, sustain electrode $SUS_j$, and conductor $CW_j$. In odd-numbered rows, they are arranged in the order of scan electrode $SCN_j$, sustain electrode $SUS_j$, and conductor $CW_j$. In contrast, in even-numbered rows, they are arranged in the order of conductor $CW_j$, sustain electrode $SUS_j$, and scan electrode $SCN_j$. Conductor $CW_j$ and sustain electrode $SUS_j$ are electrically interconnected. Scan electrodes $SCN_1$–$SCN_{2M}$ are connected to a scan electrode driving circuit 6 on the left side of the panel, and conductors $CW_1$–$CW_{2M}$ are electrically connected to sustain electrodes $SUS_1$–$SUS_{2M}$ on the right side of the panel and connected to a sustain electrode driving circuit 7 on the left side of the panel. Data electrodes $D_1$–$D_N$ are coupled with a data electrode driving circuit 4 on the upside of the panel.

In panel 20, scan electrode $SCN_{2j}$ and $SCN_{2j+1}$ to which the same voltage is applied are adjoining each other between the even-numbered row and the odd-numbered row. The distance between any adjoining scan electrodes is set to be as wide as possible. Thus, when a scan pulse voltage is sequentially applied to the scan electrodes in a writing operation, it generates a writing discharge between the data electrode and the scan electrode in the even-numbered row. The discharge is prevented from being a false discharge between the scan electrode in the odd-numbered row following the scan electrode in the even-numbered row and the data electrode.

The driving method for panel 20 is same as the driving method of the first embodiment described using the operation of the driving time-chart in FIG. 3. The effects of the panel and a driving apparatus of the second embodiment of the present invention will be described.

Figure 9:
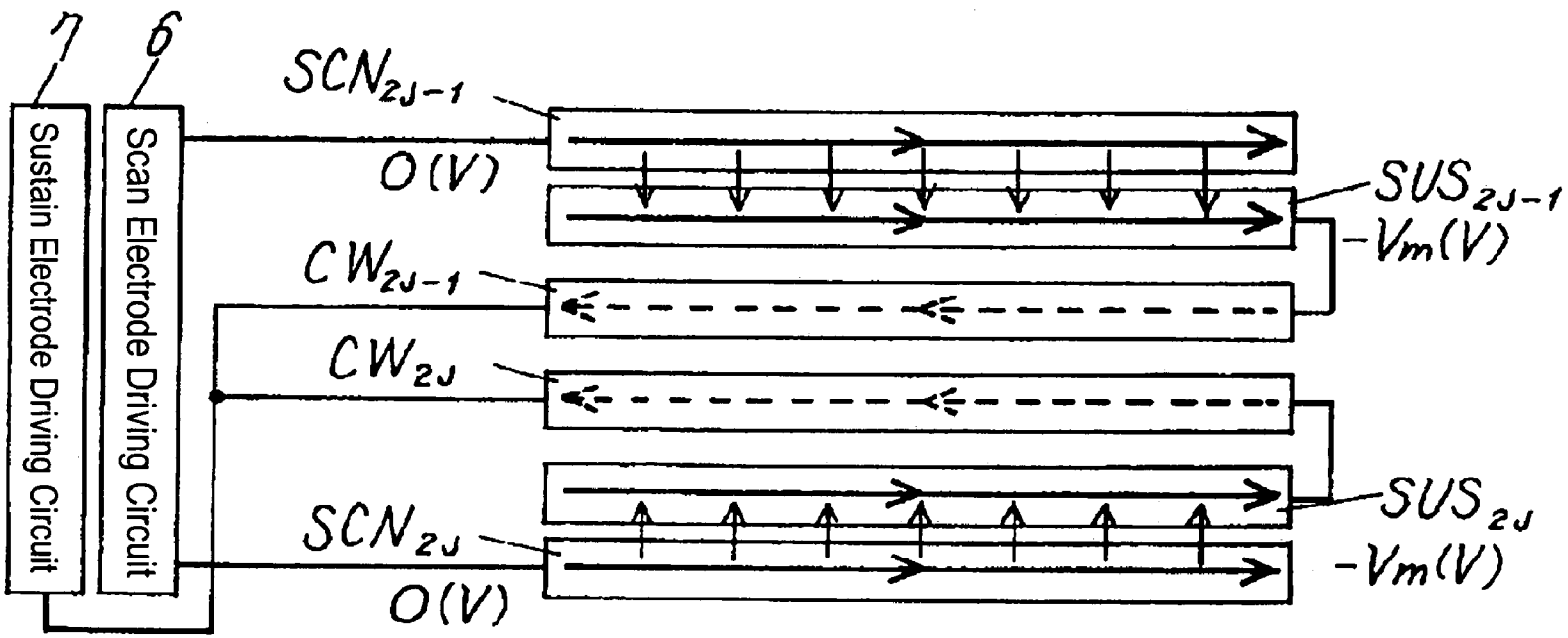
FIG. 9 shows a partial electrode array of the panel and the driving apparatus in accordance with the second embodiment of the present invention.
Figure 10:
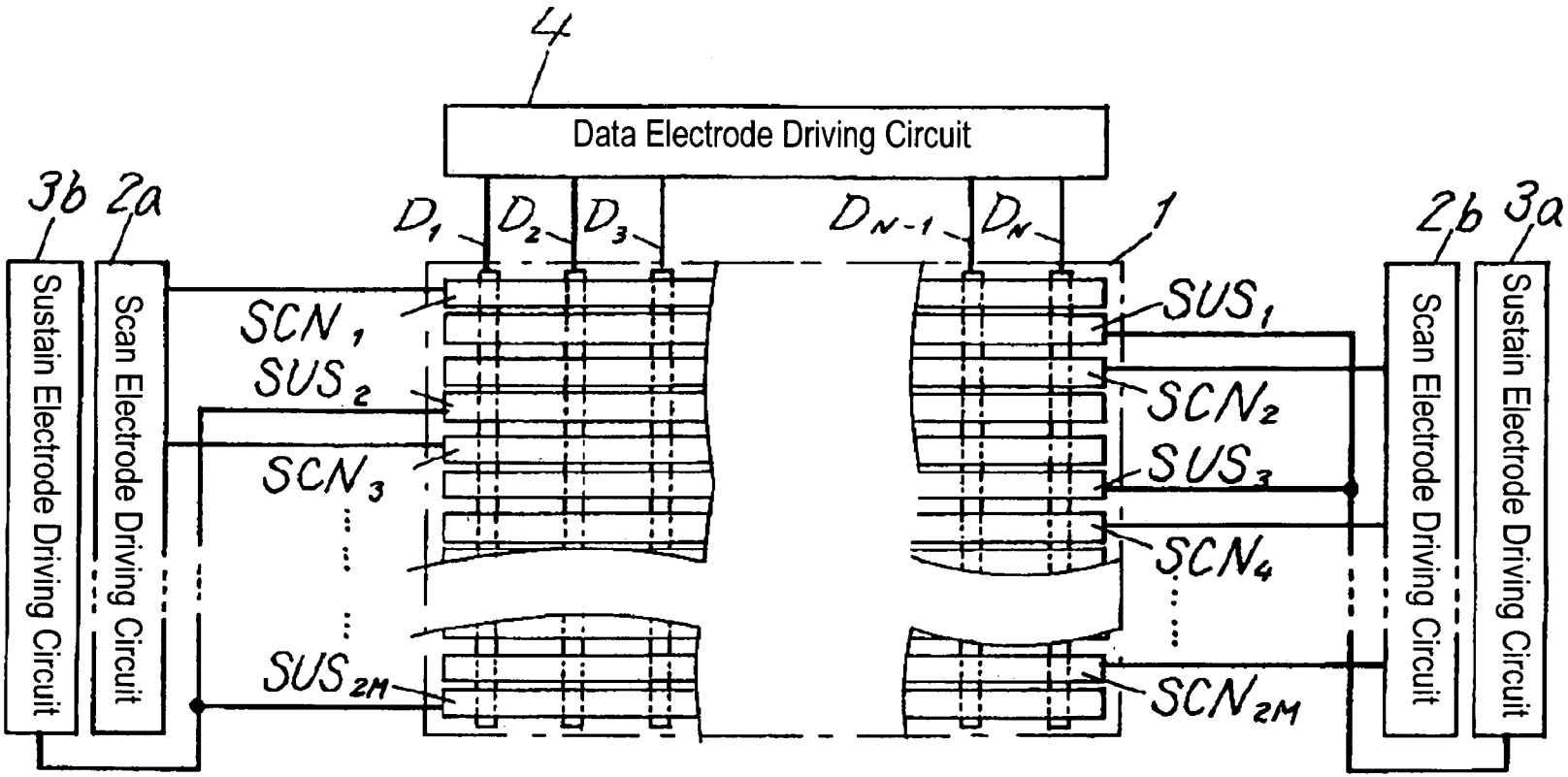
Fig. 10 PRIOR ART
FIG. 10 is a schematic block diagram of a conventional panel and its driving apparatus.

FIG. 9 is an electrode arrangement diagram of the (2j−1)-th and 2j-th rows as a part of the electrode arrangement of panel 20 as shown in FIG. 8. FIG. 9 shows a sustaining discharge current running in the initial sustaining discharge during a sustaining period. A sustaining discharge current running from the scan electrode driving circuit 6 through a pair of scan electrode $SCN_{2j-1}$ and sustain electrode $SUS_{2j-1}$ runs through conductor $CW_{2j-1}$ toward the sustain electrode driving circuit 7. The direction of the sustain discharge current (shown by thick solid arrows) running through scan electrode $SCN_{2j-1}$ and sustain electrodes $SUS_{2j-1}$ is opposite to that of the current (shown by thick dotted arrows) running through conductor $CW_{2j-1}$. Because these currents are supplied from either the scan electrode driving circuit 6 or the sustain electrode driving circuit 7 in the repeatedly continuing sustaining discharge, they always simultaneously run in reserve directions. Therefore, during the sustaining discharge, an electromagnetic wave released by the current running through a pair of scan electrode $SCN_{2j-1}$ and sustain electrode $SUS_{2j-1}$ and an electromagnetic wave released by the current running through conductor $CW_{2j-1}$ respectively have reverse polarities and thus perfectly cancel each other. In addition, for example, scan electrode $SCN_{2j-2}$ in any row and scan electrode $SCN_{2j-1}$ in the next row, sustain electrode $SUS_{2j-1}$ and conductor $CW_{2j<1}$, and conductor $CW_{2j}$ respectively are at the same voltage, and therefore no capacitive current ever runs between each pair of them. As a result, no electromagnetic wave is generated from these parts, and the total electromagnetic wave does not radiate out of the panel.

The effects for the electrodes in the (2j−1)-th and 2j-th rows are discussed above. However, the effects for the other rows are similar, and radiation of the electromagnetic wave out of the panel is suppressed.

By forming a barrier rib similar to that described in the first embodiment on dielectric layer 9 between scan electrodes adjoining each other, the writing discharge generated in a row is prevented from being a false discharge in its adjoining row.

In the panel and the driving apparatus of the second embodiment of the present invention, the scan electrode, the sustain electrode, and the conductor are arranged in the order of the scan electrode, the sustain electrode, and the conductor in each odd-numbered row, and in the order of the conductor, the sustain electrode, the scan electrode in each even-numbered row. Also, they may be arranged in the order of the conductor, the sustain electrode, and the scan electrode in each odd-numbered row, and in the order of the scan electrode, the sustain electrode, and the conductor in each even-numbered row, oppositely to that in each odd-numbered row. The current running through the scan electrodes and the sustain electrodes and the current running through the conductors run respectively in a direction reverse to each other even when the conductors are electrically connected to the scan electrodes, the scan electrode driving circuit is connected to the conductors, and the sustain electrode driving circuit is coupled to the sustain electrodes.

Examples where a conductor is arranged in each row are described in the embodiments discussed above. However, one conductor may be arranged for plural rows of scan electrodes and sustain electrodes, and the total current running through these scan electrodes and sustain electrodes may run through the conductor. For example, one conductor may be disposed at the end of the panel, and the total current running through all of the scan electrodes and the sustain electrodes may run through the conductor. In this case, the canceling effect of the electromagnetic waves is weakened compared to the case where one conductor is disposed in each row, but depending on size of the panel, radiation of the electromagnetic wave out of the panel is suppressed in a range where other apparatuses are not affected.

Technology discussed above can be applied to an AC plasma display panel having a constitution other than that of the AC plasma display panel used in the embodiments of the present invention or a driving method other than the exemplary driving method.

What is claimed is:

1. An alternating current (AC) plasma display panel comprising:

a first substrate and a second substrate, said first substrate and said second substrate disposed facing each other to form a discharge space, and at least one of said first substrate and said second substrate being transparent;

first and second display electrodes disposed over said first substrate and arranged in rows adjacent to each other, each of said first and second display electrodes comprising a scan electrode and a sustain electrode located adjacent to each other, a sustaining discharge being generated between said scan electrode and said sustain electrode of each of said first and second display electrodes;

one or more conductors disposed over said first substrate, each of said conductors being adjacent to a respective one of said first and second display electrodes, each of said conductors being spaced from said scan electrode and said sustain electrode of a respective one of said first and second display electrodes, and one of said conductors being electrically connected to said sustain electrode of said first display electrodes;

a plurality of data electrodes disposed over said second substrate, said plurality of data electrodes being disposed perpendicular to said first and second display electrodes, discharge cells being provided at intersections of said data electrodes and said first and second display electrodes;

a plurality of phosphors placed along said data electrodes, respectively;

a dielectric layer covering said display electrodes and said conductors; and a barrier disposed on said dielectric layer such that said barrier extends longitudinally approximately parallel with said conductors;

wherein said conductors are arranged so that, when a pulse voltage is applied to said display electrodes, currents run through said conductors in a reverse direction to a current running through said display electrodes;

wherein currents flow in said conductors so as to generate an electromagnetic wave having a polarity that is reverse of a polarity of an electromagnetic wave generated by a current running through a respective one of said display electrodes; and wherein, in order to prevent a discharge between said one of said conductors and said scan electrode of said second display electrode a distance between said one of said conductors and said scan electrode of said second display electrodes is longer than a distance between said scan electrode of said first display electrode and said sustain electrode of said first display electrode.

2. The AC plasma display panel according to claim 1, wherein an arrangement order of said one of said conductors and said first display electrode is reverse to an arrangement order of another one of said conductors and said second display electrode.

3. The AC plasma display panel according to claim 1, wherein said barrier is disposed between said first display electrode and said second display electrode.

4. The AC plasma display panel according to claim 3, wherein said barrier is made of photo-absorptive material.

* * * * *